US007270521B2

(12) United States Patent
Sung et al.

(10) Patent No.: US 7,270,521 B2
(45) Date of Patent: Sep. 18, 2007

(54) VARIABLE CAPACITY ROTARY COMPRESSOR WITH PRESSURE ADJUSTMENT DEVICE

(75) Inventors: Chun Mo Sung, Hwasung-Si (KR); Sung Hea Cho, Suwon-Si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 154 days.

(21) Appl. No.: 11/125,080

(22) Filed: May 10, 2005

(65) Prior Publication Data

US 2006/0104845 A1 May 18, 2006

(30) Foreign Application Priority Data

Nov. 15, 2004 (KR) ..... 10-2004-0093190

(51) Int. Cl.

| | |
|---|---|
| ***F01C 20/18*** | (2006.01) |
| ***F03C 2/00*** | (2006.01) |
| ***F03C 4/00*** | (2006.01) |
| ***F04C 2/00*** | (2006.01) |
| ***F04C 14/18*** | (2006.01) |
| ***F04C 28/18*** | (2006.01) |

(52) U.S. Cl. ..... 418/29; 418/30; 418/140; 418/263; 418/266

(58) Field of Classification Search ..... 418/29, 418/30, 140, 263, 58, 23, 60, 8, 22, 11, 32, 418/180, 266; 417/221, 310

See application file for complete search history.

(56) References Cited

U.S. PATENT DOCUMENTS 6,132,177 A * 10/2000 Loprete et al. ..... 417/221

6,616,428 B2 * 9/2003 Ebara et al. ..... 418/11

FOREIGN PATENT DOCUMENTS

| | | | |
|---|---|---|---|
| JP | 61-129495 | A | 6/1986 |
| JP | 04-187892 | A | 7/1992 |
| JP | 05-5497 | A | 1/1993 |
| KR | 10-2000-0059642 | A | 10/2000 |
| KR | 10-2004-0032358 | A | 4/2004 |
| KR | 10-2004-0067441 | A | 7/2004 |

* cited by examiner

*Primary Examiner*—Thomas Denion
*Assistant Examiner*—Douglas J. Duff
(74) *Attorney, Agent, or Firm*—Sughrue Mion Pllc.

(57) ABSTRACT

A variable capacity rotary compressor capable of equalizing an interior pressure (i.e., discharge pressure) of a hermetically sealed container with an interior pressure of a compression chamber where an idling operation is performed, resulting in a reduction of rotation resistance of a rotary shaft. The variable capacity rotary compressor includes housings disposed in the hermetically sealed container and having an interior space partitioned by intermediate plates into first and second compression chambers with different capacities, a rotary shaft rotatably disposed in the two compression chambers, eccentric units to selectively induce a compression operation in one of the two compression chambers depending on a rotational direction of the rotary shaft, and a pressure adjustment unit to apply the discharge pressure of the hermetically sealed container to one of the compression chambers where the idling operation is performed. The intermediate plates include first and second intermediate plates stacked one above another, and the pressure adjustment unit is interposed between the first and second intermediate plates.

8 Claims, 9 Drawing Sheets

VARIABLE CAPACITY ROTARY COMPRESSOR WITH PRESSURE ADJUSTMENT DEVICE

CROSS-REFERENCE TO RELATED APPLICATION

This application claims priority from Korean Patent Application No. 2004-93190, filed on Nov. 15, 2004 in the Korean Intellectual Property Office, the disclosure of which is incorporated herein by reference.

BACKGROUND OF THE INVENTION

1. Field of the Invention

The present invention relates to a variable capacity rotary compressor and, more particularly, to a variable capacity rotary compressor having a pressure adjustment unit that is capable of equalizing an interior pressure of a hermetically sealed container with an interior pressure of one of two compression chambers wherein an idling operation is performed.

2. Description of the Related Art

Technology for a variable capacity rotary compressor that is capable of varying refrigerant compression capacity is disclosed in Korean Patent Application No. 10-2002-0061462 filed by the applicant of the present invention. The disclosed variable capacity rotary compressor has an eccentric unit that allows selective eccentric rotation of a roller disposed in a respective one of two compression chambers depending on a rotational direction of a rotary shaft, thereby selectively performing a compression operation. Such an eccentric unit comprises: two eccentric cams formed on the outer circumference of the rotary shaft while corresponding to the compression chambers, respectively; two eccentric bushes rotatably coupled around the two eccentric cams to bear rollers against their outer circumferences, respectively; and a latch pin for latching one of the two eccentric bushes to its eccentric position and the other one to its non-eccentric position upon rotation of the rotary shaft.

Such a variable capacity rotary compressor allows the compression operation to be performed in only one of the two compression chambers with different capacities, thereby realizing variable capacity operation through simple change of the rotational direction of the rotary shaft.

SUMMARY OF THE INVENTION

Therefore, the present invention has been made in order to improve functions of the conventional variable capacity rotary compressor as mentioned above, and it is an aspect of the invention to provide a variable capacity rotary compressor which can equalize an interior pressure (i.e., discharge pressure) of a hermetically sealed container with an interior pressure of one of the compression chambers wherein an idling operation is performed, thereby being capable of minimizing rotation resistance of a rotary shaft.

Additional aspects and/or advantages of the invention will be set forth in part in the description which follows and, in part, will be apparent from the description, or may be learned by practice of the invention.

In accordance with one aspect, the present invention provides a variable capacity rotary compressor comprising: housings disposed in a hermetically sealed container and having an interior space partitioned by intermediate plates into first and second compression chambers with different capacities; a rotary shaft rotatably disposed in the two compression chambers; eccentric units to selectively induce a compression operation in one of the two compression chambers depending on a rotational direction of the rotary shaft; and a pressure adjustment unit to apply a discharge pressure of the hermetically sealed container to one of the compression chambers where an idling operation is performed, wherein the intermediate plates include first and second intermediate plates stacked one above another, and the pressure adjustment unit is interposed between the first and second intermediate plates.

The pressure adjustment unit may include: a channel switching cavity formed at contact areas of the first and second intermediate plates to accommodate the discharge pressure of the hermetically sealed container; first and second communication bores formed, respectively, in the first and second intermediate plates to communicate at their one side with the channel switching cavity and at their opposite side with the first and second compression chambers; and a valve member vertically movably disposed in the channel switching cavity to selectively close one of the first and second communication bores associated with the compression chamber where the compression operation is performed.

The channel switching cavity may have first and second recessed portions formed, respectively, in the first and second intermediate plates to have a predetermined depth from a contact plane between the first and second intermediate plates.

The first and second communication bores may have an inner diameter smaller than an inner diameter of the channel switching cavity.

The pressure adjustment unit may further include: first connection passages perforated through the housings and the first and second intermediate plates to define vertical channels through the housings and the intermediate plates so as to apply the discharge pressure of the hermetically sealed container to the channel switching cavity; and a second connection passage formed in at least one of facing surfaces of the first and second intermediate plates to communicate with the first connection passages and the channel switching cavity.

The second connection passage may have a groove form recessed in one of the facing surfaces of the first and second intermediate plates.

The eccentric units may include: first and second eccentric cams formed, respectively, on the outer circumference of the rotary shaft disposed in the first and second compression chambers; first and second eccentric bushes rotatably coupled around the outer circumferences of the eccentric cams, respectively; and a latch unit configured to allow one of the two eccentric bushes to be eccentrically rotated and the other eccentric bush to be latched to the latch unit in its non-eccentric state as the rotary shaft rotates in a forward or reverse direction.

BRIEF DESCRIPTION OF THE DRAWINGS

These and/or other aspects and advantages of the invention will become apparent and more readily appreciated from the following description of the exemplary embodiments, taken in conjunction with the accompanying drawings, in which.

Figure 1:
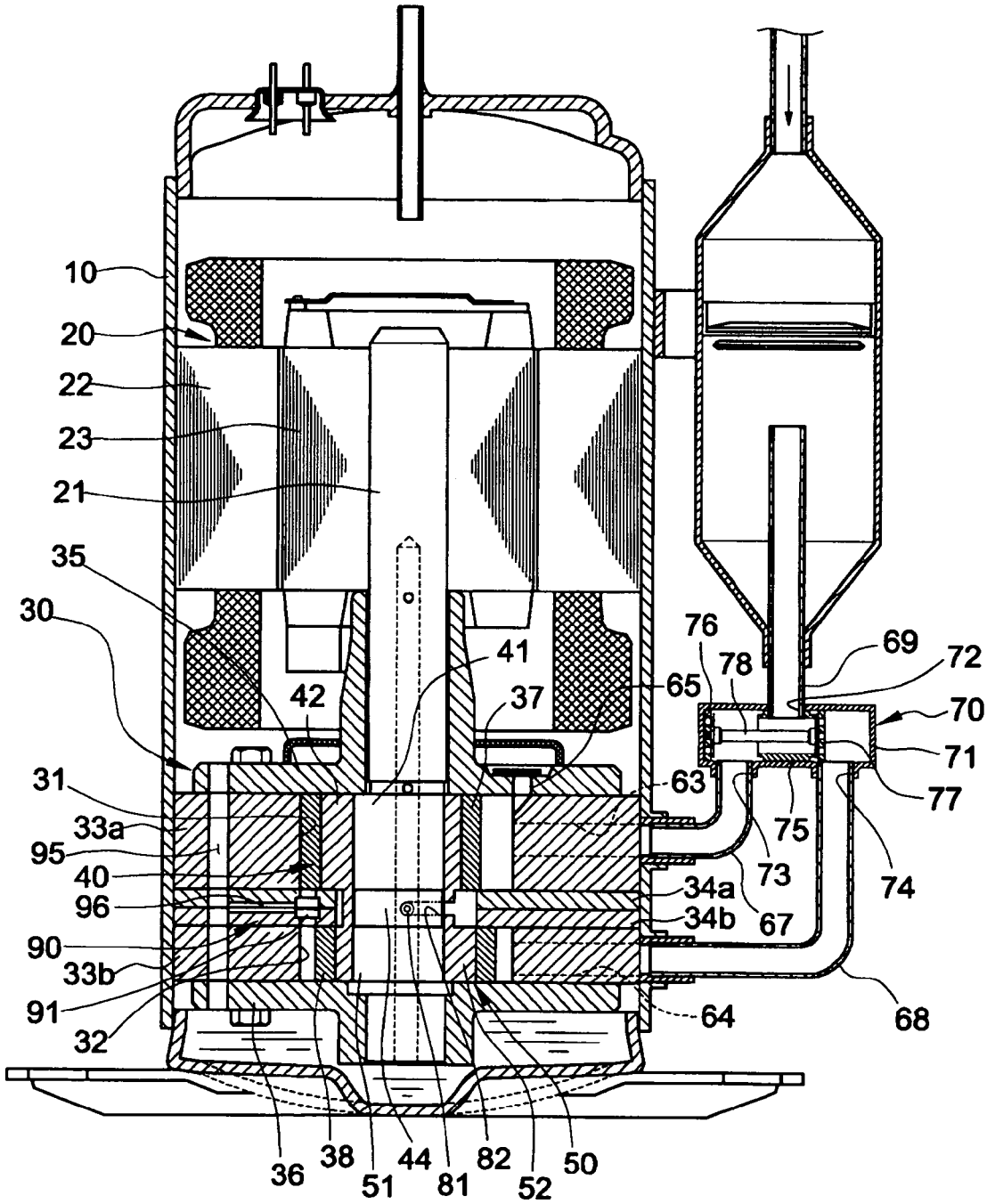
FIG. 1 is a longitudinal sectional view showing the interior structure of a variable capacity rotary compressor consistent with the present invention.

DETAILED DESCRIPTION OF THE ILLUSTRATIVE, NON-LIMITING EMBODIMENTS OF THE INVENTION

Reference will now be made in detail to the illustrative, non-limiting embodiment of the present invention, examples of which are illustrated in the accompanying drawings, wherein like reference numerals refer to like elements throughout. The exemplary embodiment is described below to explain the present invention by referring to the figures.

FIG. 1 is a longitudinal sectional view showing the interior structure of a variable capacity rotary compressor consistent with the present invention. As shown in FIG. 1, the variable capacity rotary compressor comprises: a driving unit 20 disposed in an upper portion of a hermetically sealed container 10 to generate a rotary force; and a compressing unit 30 disposed in a lower portion of the hermetically sealed container 10 to be connected to the driving unit 20 via a rotary shaft 21.

The driving unit 20 comprises: a cylindrical stator 22 fixed on the inner circumference of the hermetically sealed container 10; and a rotor 23 rotatably disposed in the stator 22 to be centrally fitted on the rotary shaft 21. The driving unit 20 rotates the rotary shaft 21 in a forward or reverse direction.

The compressing unit 30 comprises: upper and lower housings, respectively, defining cylindrical first and second compression chambers 31 and 32 with different capacities. As shown in FIGS. 1 to 7, the housings are first and second housings 33*a* and 33*b*, respectively, defining the first and second compression chambers 31 and 32. Upper and lower flanges 35 and 36 are mounted, respectively, at an upper surface of the first housing 33*a* and a lower surface of the second housing 33*b* to close the top of the first compression chamber 31 and the bottom of the second compression chamber 32 while rotatably supporting the rotary shaft 21. Between the first and second housings 33*a* and 33*b* are interposed first and second intermediate plates 34*a* and 34*b*, so that the first and second intermediate plates 34*a* and 34*b* are stacked one above another and serve to partition the first and second compression chambers 31 and 32.

In the first and second compression chambers 31 and 32 are disposed, respectively, a first eccentric unit 40 and a second eccentric unit 50 around the rotary shaft 21, as shown in FIGS. 1 to 4. The first and second eccentric units 40 and 50 bear against first and second rollers 37 and 38 rotatably coupled at the outer circumferences of the first and second eccentric units 40 and 50, respectively. Between an inlet 63 and an outlet 65 of the first compression chamber 31 is disposed a first vane 61, and between an inlet 64 and an outlet 66 of the second compression chamber 32 is disposed a second vane 62. The first and second vanes 61 and 62 are selectively pressed against the first and second rollers 37 and 38 as they radially move forward or backward in contact with outer circumferences of the rollers 37 and 38. The first and second vanes 61 and 62 are supported by means of first and second vane springs 61*a* and 62*a*, respectively. The inlet 63 and the outlet 65 of the first compression chamber 31 and the inlet 64 and the outlet 66 of the second compression chamber 32 are positioned at opposite sides of the respective vanes 61 and 62. Although not shown concretely, the outlets 65 and 66 communicate with the interior of the hermetically sealed container 10 via channels formed in the housings 33*a* and 33*b*.

The first and second eccentric units 40 and 50, disposed in the first and second compression chambers 31 and 32, comprise: first and second eccentric cams 41 and 51 formed on the outer circumference of the rotary shaft 21 disposed in the respective compression chambers 31 and 32 to be eccentrically rotated in the same direction as each other; and first and second eccentric bushes 42 and 52 rotatably coupled around the outer circumferences of the eccentric cams 41 and 51, respectively. As can be seen from FIG. 2, the upper first eccentric bush 42 and the lower second eccentric bush 52 are integrally connected to each other via a cylindrical connection portion 43 so as to be eccentrically rotated in directions opposite to each other. The first and second rollers 37 and 38 are rotatably coupled to the outer circumferences of the first and second eccentric bushes 42 and 52, respectively.

Figure 2:
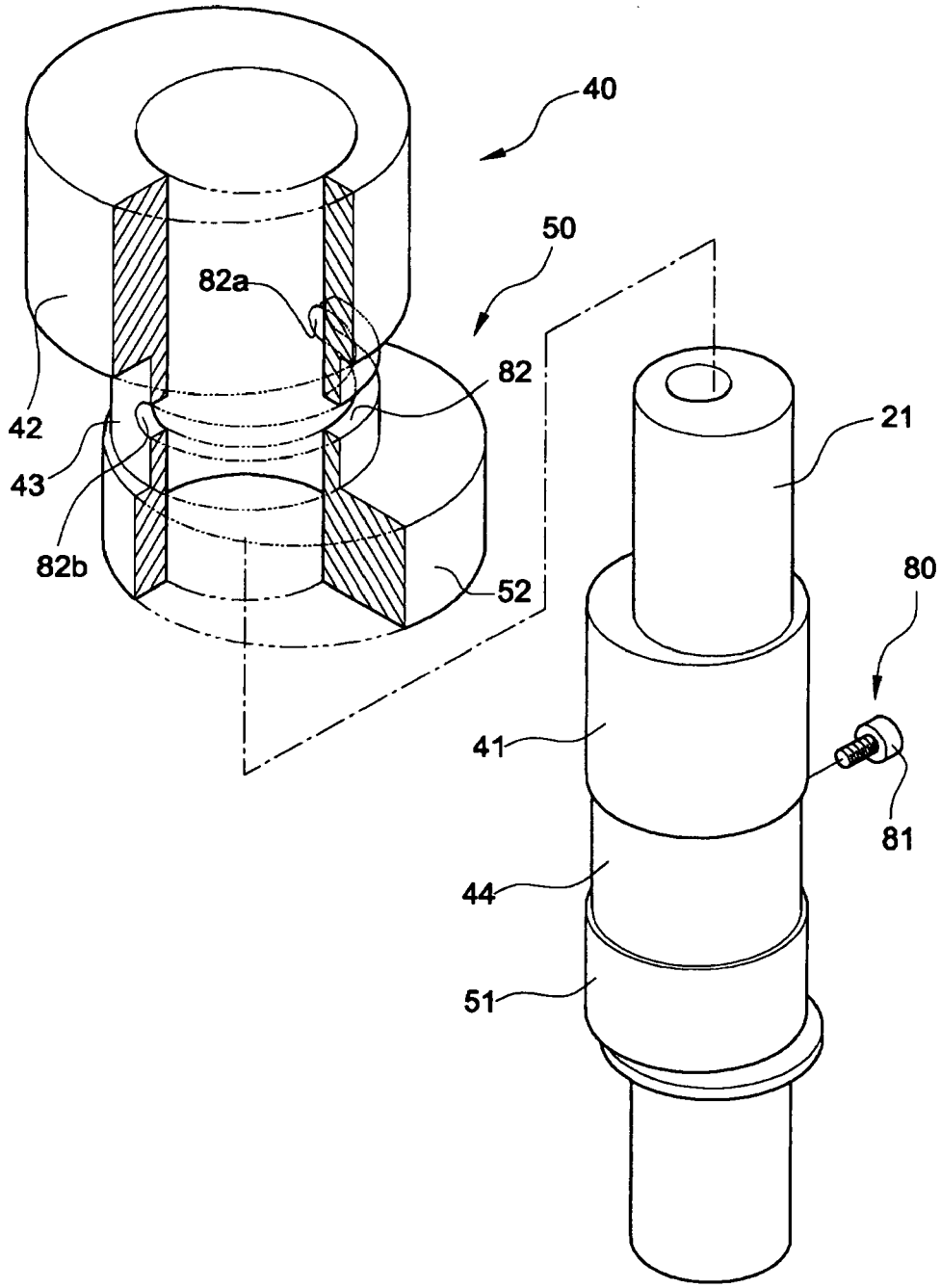
FIG. 2 is an exploded perspective view showing an eccentric unit provided in the variable capacity rotary compressor of FIG. 1.
Figure 3:
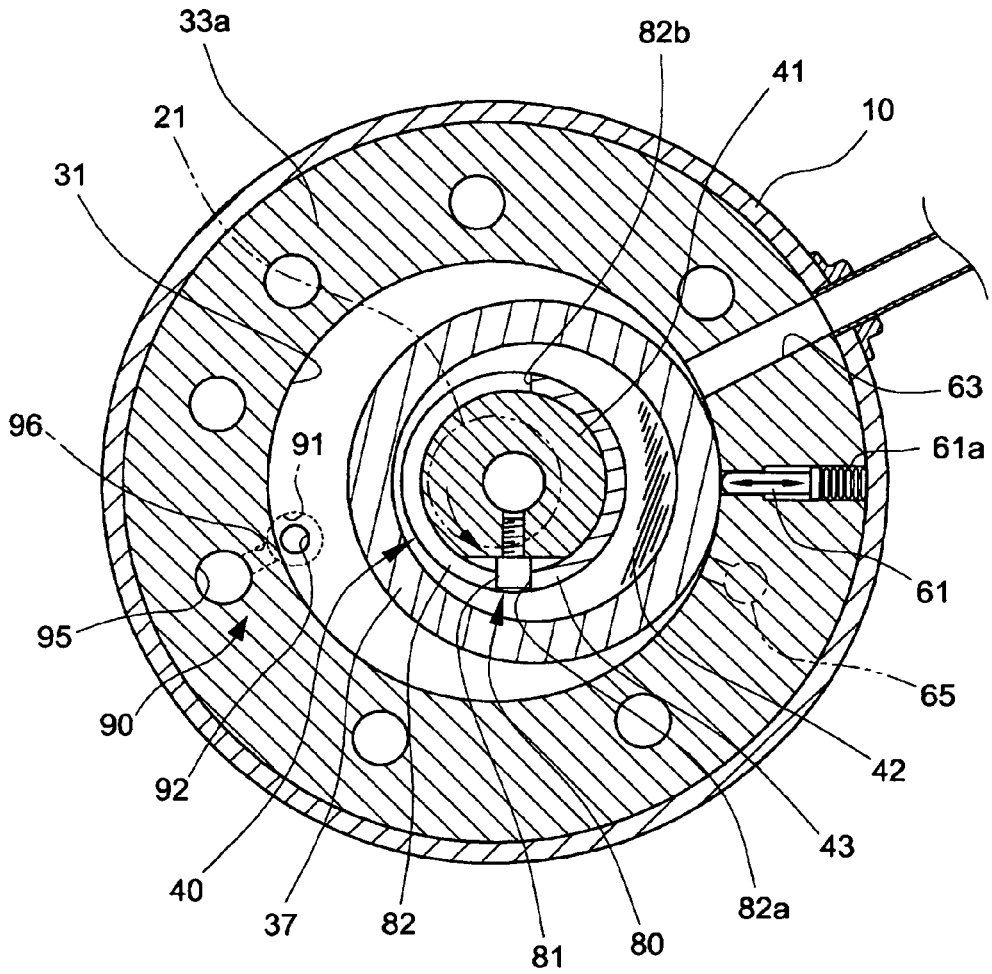
FIG. 3 is a cross-sectional view showing a compression operation performed in a first compression chamber when a rotary shaft of the variable capacity rotary compressor is rotated in a first rotational direction.

On the outer circumference of the rotary shaft 21 between the first and second eccentric cams 41 and 51 is formed an eccentric portion 44 as shown in FIGS. 2 and 3. The eccentric portion 44 is designed to be eccentrically rotated in the same manner as the eccentric cams 41 and 51. To the eccentric portion 44 is mounted a latch unit 80. The latch unit 80 allows selective eccentric rotation of the eccentric bushes 42 and 52 depending upon the rotational direction of the rotary shaft 21. The latch unit 80 comprises: a latch pin 81 screwed into the outer circumference of the eccentric portion 44 to protrude outward; and a slot 82 formed along the circumference of the connection portion 43 connecting the first and second eccentric bushes 42 and 52. The slot 82, having a relatively long length, allows that the latch pin 81 is latched to predetermined locations thereof corresponding to eccentric and non-eccentric positions of the eccentric bushes 42 and 52 as the rotary shaft 21 is rotated in a forward or reverse direction.

With such a configuration as described above, in a state wherein the latch pin 81 screwed into the eccentric portion 44 of the rotary shaft 21 is inserted into the slot 82 of the connection portion 43, the latch pin 81 is rotatable over a predetermined angle upon rotation of the rotary shaft 21, so that it is latched to either first or second end 82*a* or 82*b* of the slot 82, causing the eccentric bushes 42 and 52 to rotate along with the rotary shaft 21. When the latch pin 81 is latched to either first or second end 82*a* or 82*b* of the slot 82, one of the two eccentric bushes 42 or 52 is in an eccentric state, whereas the other one of the eccentric bushes 52 or 42 is in a non-eccentric state, thereby allowing one of the compression chambers 31 or 32 to perform a compression operation and the other one of the compression chambers 32 or 31 to perform an idling operation. If the rotational direction of the rotary shaft 21 changes, the eccentric state of the eccentric bushes 42 and 52 is reversed.

As shown in FIG. 1, the variable capacity rotary compressor according to the present invention further comprises a channel switching unit 70 to selectively open/close introducing channels such that a refrigerant in a suction channel 69 is introduced into the inlet 63 or 64 of one of the first and second compression chambers 31 and 32 where the compression operation is performed.

The channel switching unit 70 comprises a cylindrical body 71, and a valve unit mounted in the body 71. To an entrance 72, centrally formed at an upper surface of the cylindrical body 71, is connected the suction channel 69, and to first and second exits 73 and 74 formed at opposite sides of the cylindrical body 71 are connected introducing channels 67 and 68. The channels 67 and 68 are connected to the inlets 63 and 64 of the first and second compression chambers 31 and 32, respectively. The valve unit, mounted in the body 71, comprises: a cylindrical valve seat 75 mounted in the center of the body 71; first and second opening/closing members 76 and 77 movably disposed at opposite sides of the valve seat 75 in the body 71 so as to open or close opposite ends of the valve seat 75; and a connecting member 78 connecting the first and second opening/closing members 76 and 77 to enable simultaneous movement of the opening/closing members 76 and 77. In such a channel switching unit 70, on the basis of the pressure difference between the exit 73 and the exit 74 caused when the compression operation is performed in only one of the first and second compression chambers 31 and 32, the first and second opening/closing members 76 and 77 disposed in the body 71 move toward a low pressure region, achieving automatic switching of the introducing channels 67 and 68. That is, one of the introducing channels 67 and 68 is used to introduce the refrigerant into one of the compression chambers 31 and 32 where the compression operation is performed.

The variable capacity rotary compressor consistent with the present invention further comprises a pressure adjustment unit 90 as shown in FIG. 1. The pressure adjustment unit 90 serves to apply a discharge pressure of the hermetically sealed container 10 into one of the first and second compression chambers 31 and 32 where the idling operation is performed, so as to equalize an interior pressure of the hermetically sealed container 10 with an interior pressure of the idling compression chamber.

Figure 7:
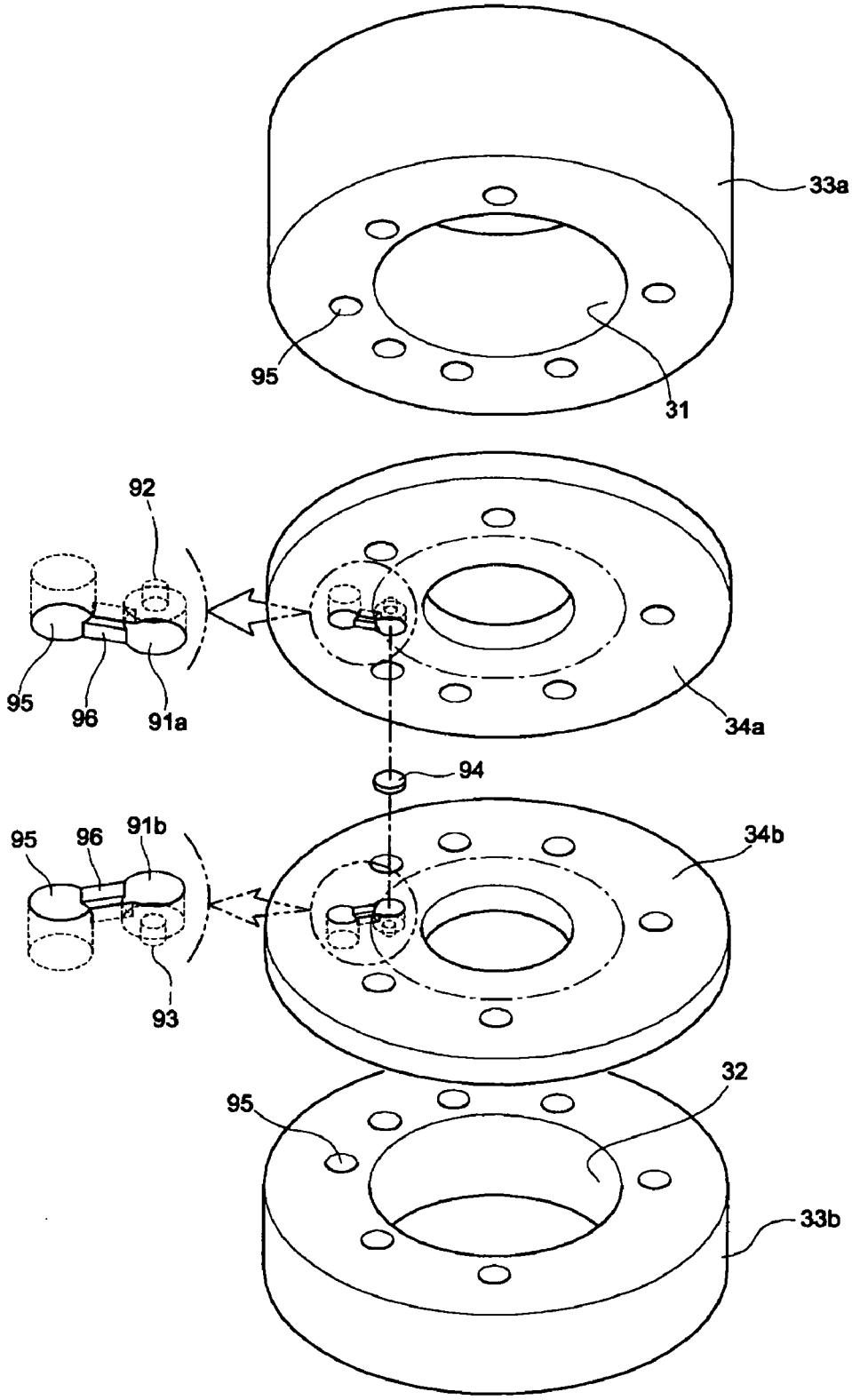
FIG. 7 is an exploded perspective view showing intermediate plates and a pressure adjustment unit provided in the variable capacity rotary compressor of FIG. 1.
Figure 8:
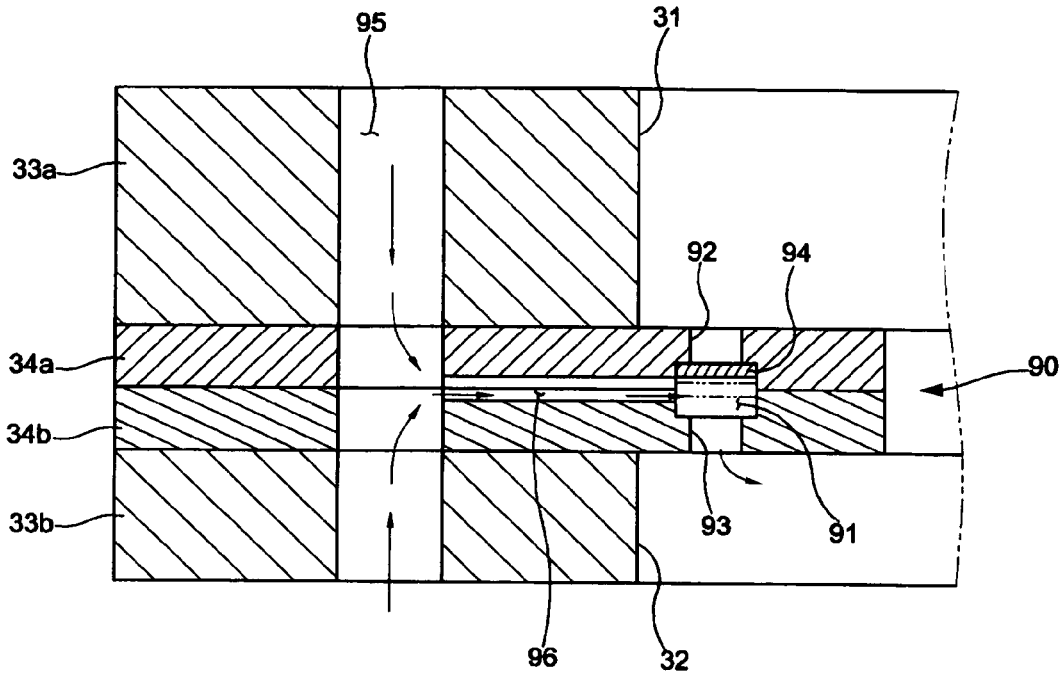
FIG. 8 is a sectional view of the pressure adjustment unit of FIG. 7, when the second compressor chamber performs the idling operation.

With reference to FIGS. 7 and 8, the configuration and operation of the pressure adjustment unit 90 will now be described in detail. The pressure adjustment unit 90 comprises: a channel switching cavity 91 defined in the first and second intermediate plates 34*a* and 34*b*, which are used to partition the first and second compression chambers 31 and 32; and a valve member 94 seated to move vertically in the channel switching cavity 91 and first and second communication bores 92 and 93. Here, the first and second communication bores 92 and 93 are formed, respectively, at the first and second intermediate plates 34*a* and 34*b*. Through such a vertical movement, the valve member 94 serves to selectively communicate the channel switching channel 91 with one of the first and second communication bores 92 and 93. As shown in FIGS. 1 and 8, the pressure adjustment unit 90 further comprises: first connection passages 95 perforated through the first and second housings 33*a* and 33*b* and the first and second intermediate plates 34*a* and 34*b* to define vertical channels through the housings 33*a* and 33*b* and the intermediate plates 34*a* and 34*b* so as to apply the discharge pressure of the hermetically sealed container 10 to the channel switching cavity 91; and second connection passages 96 formed in facing surfaces of the first and second intermediate plates 34*a* and 34*b* to communicate with the first connection passages 95 and the channel switching cavity 91.

Considering the pressure adjustment unit 90 in more detail with reference to FIG. 7, the channel switching cavity 91 includes a first recessed portion 91*a* and a second recessed portion 91*b*, which are formed in the first and second intermediate plates 34*a* and 34*b* to have a predetermined depth from a contact plane between the first and second intermediate plates 34*a* and 34*b*. The second connection passages 96, configured to communicate with the first connection passages 95 and the channel switching cavity 91, have a groove form recessed in the facing surfaces of the first and second intermediate plates 34*a* and 34*b*.

It will be clearly understood that the pressure adjustment unit 90 as mentioned above is easy to manufacture since a partition between the two compressions 31 and 32 is constituted by the first and second intermediate plates 34*a* and 34*b*, and the first and second recessed portions 91*a* and 91*b*, defining the channel switching cavity 91, and the second connection passages 96 are recessed in the facing surfaces of the first and second intermediate plates 34*a* and 34*b*. That is, as a result of forming the first and second recessed portions 91*a* and 91*b* of the channel switching cavity 91 and the second connection passages 96 by cutting the facing surfaces of the first and second intermediate plates 34*a* and 34*b*, the processing of the channel switching cavity 91, as one component of the pressure adjustment unit 90, can be easily performed in the course of the manufacture of the compressor, and the valve member 94 can be easily inserted and fixed in the channel switching cavity 91.

The first and second communication bores 92 and 93, provided to communicate with the channel switching cavity 91 and a respective one of the compression chambers 31 and 32, have an inner diameter smaller than an inner diameter of the channel switching cavity 91. This allows the first and second communication bores 92 and 93 to be closed by the valve member 94 as the valve member 94 moves vertically in the channel switching cavity 91.

The valve member 94 has a thin circular plate form, and a diameter of the valve member 94 is larger than the diameter of the first and second communication bores 92 and 93. The valve member 94 moves vertically toward one of the compression chambers, where the compression operation is performed, upon receiving a suction force generated from the compression chamber associated with the compression operation. Thereby, the valve member 94 serves to close one of the first and second communication bores 92 and 93 of the compression chamber associated with the compression operation and to open the other communication bore of the compression chamber where the idling operation is performed. In order to allow the suction force required to operate the valve member 94 to be generated from one of the compression chambers where the compression operation is performed, it is preferable that the first and second communication bores 92 and 93, bored in the first and second intermediate plates 34*a* and 34*b*, are positioned at the opposite side of the first and second vanes 61 and 62.

Now, the operation and effects of the above described variable capacity rotary compressor will be explained.

Figure 4:
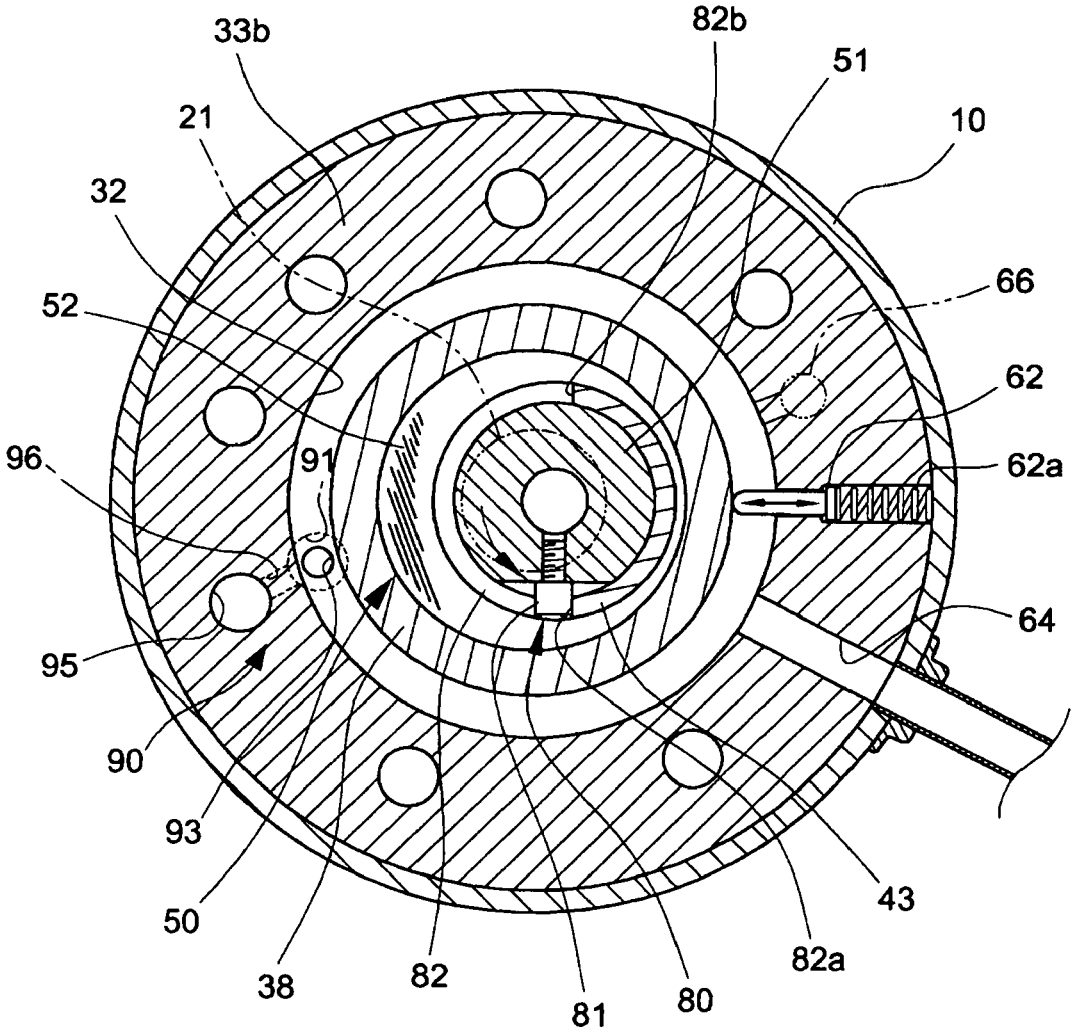
FIG. 4 is a cross-sectional view showing an idling operation performed in a second compression chamber when the rotary shaft is rotated in the first rotational direction.

When the rotary shaft 21 is rotated in a first direction as shown in FIG. 3, the outer circumference of the first eccentric bush 42 disposed in the first compression chamber 31 is eccentrically rotated relative to the rotary shaft 21 and the latch pin 81 is latched to the first end 82*a* of the slot 82. Thereby, the first roller 37 is rotated in contact with the inner circumference of the first compression chamber 31, causing a compression operation in the first compression chamber 31. In the case of the second compression chamber 32, as shown in FIG. 4, the outer circumference of the second eccentric bush 52, which is eccentrically rotated in the direction opposite to that of the first eccentric bush 42, is concentric about the rotary shaft 21, and thus the second roller 38 is spaced apart from the inner circumference of the second compression chamber 32, causing an idling operation in the second compression chamber 32. When the compression operation is performed in the first compression chamber 31, the refrigerant is introduced into the inlet 63 of the first compression chamber 31 as the channel switching unit 70 selects the introducing channel 67 for introducing the refrigerant into the first compression chamber 31.

When the first compression chamber 31 performs the compression operation, and the second compression chamber 32 performs the idling operation, as shown in FIG. 8, the valve member 94, located in the channel switching cavity 91, moves upward due to a pressure difference between the first and second compression chambers 31 and 32, thereby closing the first communication bore 92 associated with the first compression chamber 31. That is, an interior pressure of the first communication bore 92 gradually increases as the first roller 37 is eccentrically rotated in the first compression chamber 31 from a position of the first vane 61 to a position of the first communication bore 92, but to the first communication bore 92 is applied a suction force from a time point when the first roller 37 passes the first communication bore 92, thereby causing the valve member 94 to move upward into the first communication bore 92. In this case, the second communication bore 93 associated with the second compression chamber 32 is opened to communicate with the interior of the hermetically sealed container 10 via the first connection passages 95 and the second connection passages 96. Simultaneously, a fluid, compressed and discharged from the first compression chamber 31, acts to increase the interior pressure of the hermetically sealed container 10 to thereby allow the increased interior pressure of the container 10 to be applied into the second compression chamber 32 via the first and second connection passages 95 and 96 and the channel switching cavity 91. In this way, the second compression chamber 32, where the idling operation is performed, keeps the same interior pressure as the interior pressure (i.e., discharge pressure) of the hermetically sealed container 10. This prevents the second vane 62 from pressing the idling second roller 38, and prevents introduction of oil into the second compression chamber 32, achieving a reduction in rotation resistance of the rotary shaft 21 and a smooth operation of the rotary shaft 21.

Figure 5:
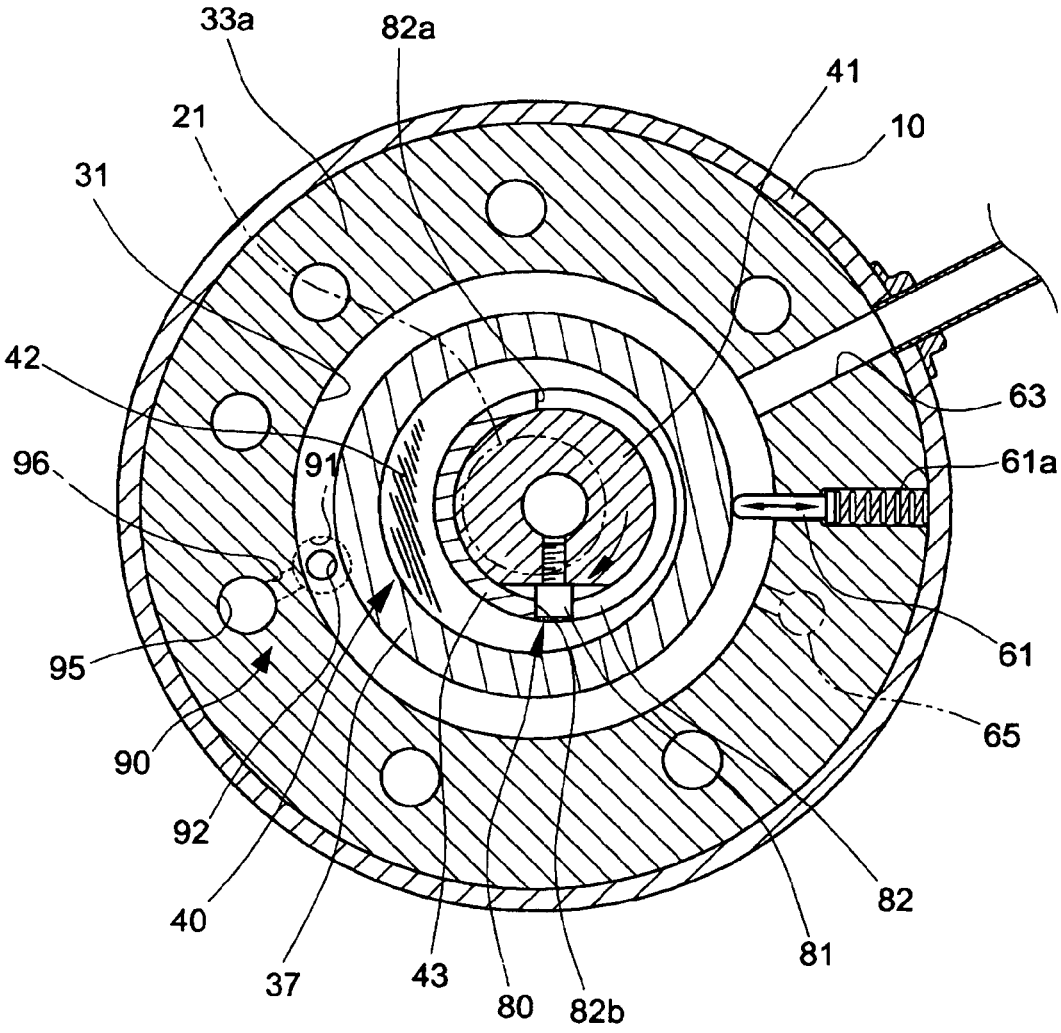
FIG. 5 is a cross-sectional view showing an idling operation performed in the first compression chamber when the rotary shaft is rotated in a second rotational direction.
Figure 6:
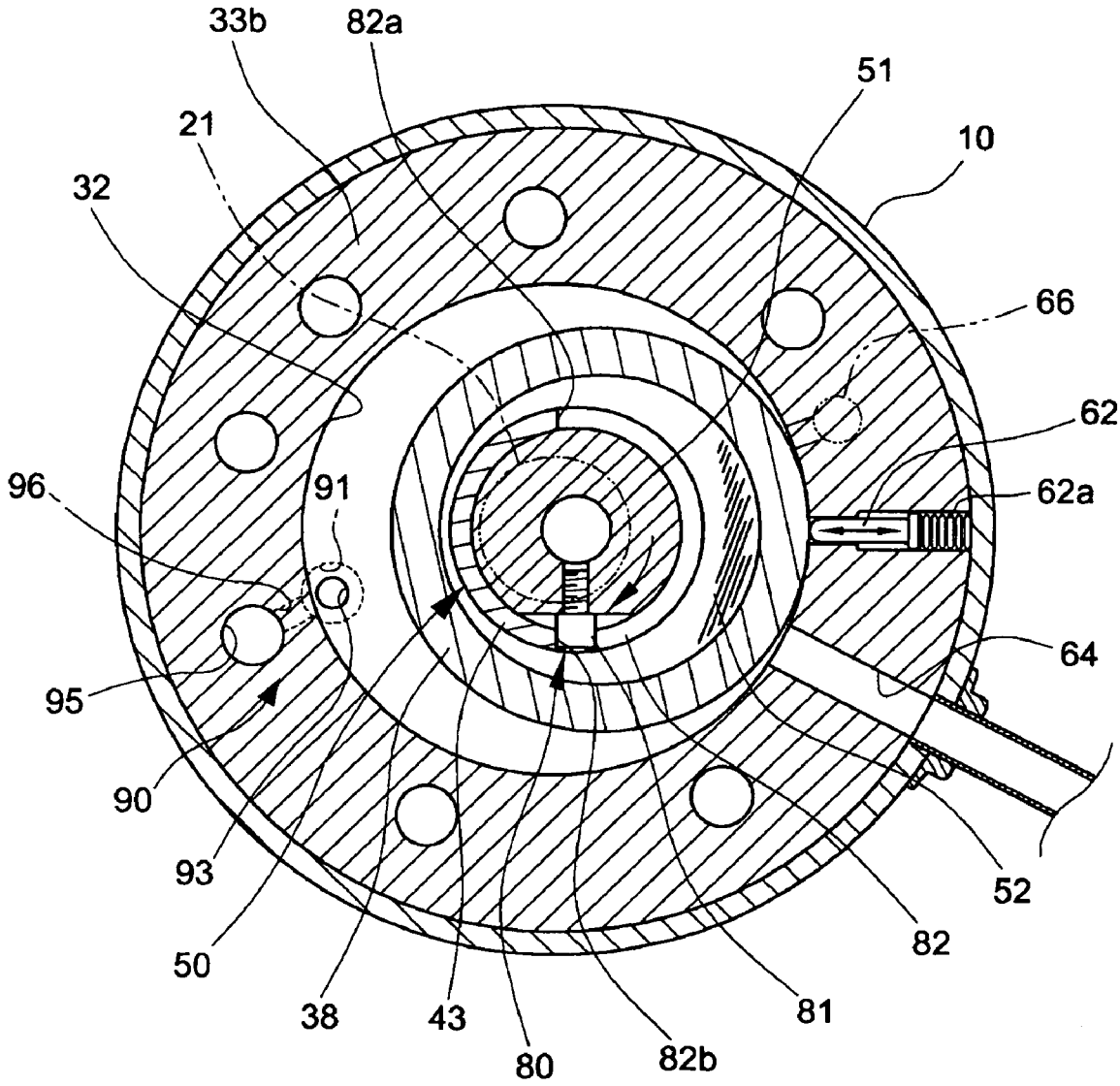
FIG. 6 is a cross-sectional view showing a compression operation performed in the second compression chamber when the rotary shaft is rotated in the second rotational direction.

When the rotary shaft 21 is rotated in the second direction opposite to the first direction, as shown in FIG. 5, the outer circumference of the first eccentric bush 42 disposed in the first compression chamber 31 is non-eccentric relative to the rotary shaft 21 and the latch pin 81 is latched to the second end 82*b* of the slot 82. Thereby, the first roller 37 is rotated while being spaced apart from the inner circumference of the first compression chamber 31, causing an idling operation in the first compression chamber 31. In the case of the second compression chamber 32, as shown in FIG. 6, the outer circumference of the second eccentric bush 52 is eccentrically rotated relative to the rotary shaft 21, and thus the second roller 38 is rotated in contact with the inner circumference of the second compression chamber 32, resulting in a compression operation in the second compression chamber 32.

Figure 9:
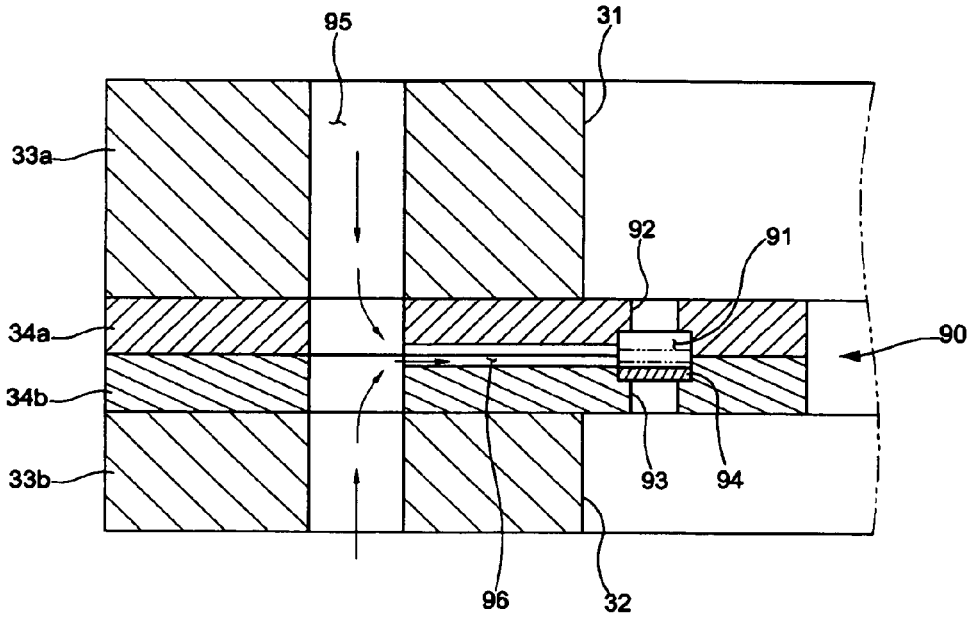
FIG. 9 is a sectional view of the pressure adjustment unit of FIG. 7, when the first compressor chamber performs the idling operation.

When the compression operation is performed in the second compression chamber 32, the refrigerant is introduced into the inlet 64 of the second compression chamber 32 as the channel switching unit 70 selects the introducing channel 68 to introduce the refrigerant into the second compression chamber 32. Further, when the second compression chamber 32 performs the compression operation, and the first compression chamber 31 performs the idling operation, as shown in FIG. 9, the valve member 94 of the pressure adjustment unit 90 moves downward toward the second compression chamber 32, thereby closing the second communication bore 93 associated with the second compression chamber 32. In this case, the first communication bore 92 associated with the first compression chamber 31 is opened to communicate with the second connection passages 96. Therefore, the first compression chamber 31 keeps the same interior pressure as the interior pressure of the hermetically sealed container 10 to thereby prevent the first vane 61 from pressing the idling first roller 37. This reduces the rotation resistance of the rotary shaft 21, enabling smooth rotation of the rotary shaft 21.

As apparent from the above description, the present invention provides a variable capacity rotary compressor having a pressure adjustment unit that operates to apply an interior pressure, i.e., discharge pressure of a hermetically sealed container to one of two compression chambers where an idling operation is performed, so as to prevent generation of a pressure difference between the interior of the idling compression chamber and the interior of the hermetically sealed container. This has the effect of preventing a vane associated with the idling compression chamber from pressing a roller and producing rotation resistance. Thereby, it is possible to minimize loss of capacity of the compressor, resulting in a corresponding improvement in the performance of the compressor.

Further, according to the present invention, partition means between the two compression chambers include first and second intermediate plates, and first and second recessed portions, defining a channel switching cavity, and connection passages are recessed in facing surfaces of the first and second intermediate plates. Such a configuration can facilitate the processing of the channel switching cavity and the insertion and fixation of a valve member of the pressure adjustment unit into the channel switching cavity.

Although exemplary embodiments of the present invention have been shown and described, it will be appreciated by those skilled in the art that changes may be made in these embodiments without departing from the principles and spirit of the invention, the scope of which is defined in the claims and their equivalents.

What is claimed is:

1. A variable capacity rotary compressor comprising:

housings disposed in a hermetically sealed container and having an interior space partitioned by intermediate plates into first and second compression chambers with different capacities;

a rotary shaft rotatably disposed in the two compression chambers;

eccentric units to selectively induce a compression operation in one of the two compression chambers depending on a rotational direction of the rotary shaft; and a pressure adjustment unit to apply a discharge pressure of the hermetically sealed container to one of the compression chambers where an idling operation is performed, wherein the intermediate plates include first and second intermediate plates stacked one above another, and the pressure adjustment unit is interposed between the first and second intermediate plates.

2. The compressor according to claim 1, wherein the pressure adjustment unit comprises:

a channel switching cavity formed at contact areas of the first and second intermediate plates to accommodate the discharge pressure of the hermetically sealed container;

first and second communication bores formed, respectively, in the first and second intermediate plates to communicate at their one side with the channel switching cavity and at their opposite side with the first and second compression chambers; and a valve member vertically movably disposed in the channel switching cavity to selectively close one of the first and second communication bores associated with the compression chamber where the compression operation is performed.

3. The compressor according to claim 2, wherein the channel switching cavity has first and second recessed portions formed, respectively, in the first and second intermediate plates to have a predetermined depth from a contact plane between the first and second intermediate plates.

4. The compressor according to claim 2, wherein the first and second communication bores have an inner diameter smaller than an inner diameter of the channel switching cavity.

5. The compressor according to claim 2, wherein the pressure adjustment unit further comprises:

first connection passages perforated through the housings and the first and second intermediate plates to define vertical channels through the housings and the intermediate plates so as to apply the discharge pressure of the hermetically sealed container to the channel switching cavity; and a second connection passage formed in at least one of facing surfaces of the first and second intermediate plates to communicate with the first connection passages and the channel switching cavity.

6. The compressor according to claim 5, wherein the second connection passage has a groove form recessed in one of the facing surfaces of the first and second intermediate plates.

7. The compressor according to claim 2, wherein the valve member has a thin flat plate form.

8. The compressor according to claim 1, wherein each of the eccentric units comprises:

first and second eccentric cams formed, respectively, on the outer circumference of the rotary shaft disposed in the first and second compression chambers;

first and second eccentric bushes rotatably coupled around the outer circumferences of the eccentric cams, respectively; and a latch unit configured to allow one of the two eccentric bushes to be eccentrically rotated and the other eccentric bush to be latched to the latch unit in its non-eccentric state as the rotary shaft rotates in a forward or reverse direction.

* * * * *